US006843013B2

(12) United States Patent
Cutini et al.

(10) Patent No.: US 6,843,013 B2
(45) Date of Patent: Jan. 18, 2005

(54) TRIGGER SAFETY LOCK FOR PISTOLS AND TRIGGER ASSEMBLY

(76) Inventors: Jorge Enrique Cutini, Martin Rodriguez 840, (1828) Banfield (AR); Fernando Mareque, Valentin Vergara 1992, (1828) Banfield (AR)

( * ) Notice: Subject to any disclaimer, the term of this patent is extended or adjusted under 35 U.S.C. 154(b) by 10 days.

(21) Appl. No.: 10/419,112

(22) Filed: Apr. 21, 2003

(65) Prior Publication Data

US 2003/0213159 A1 Nov. 20, 2003

(30) Foreign Application Priority Data

Apr. 22, 2002 (AR) ..... P020101459
Apr. 16, 2003 (AR) ..... P030101344

(51) Int. Cl.[7] ..... F41A 17/00
(52) U.S. Cl. ..... 42/70.06; 42/70.01
(58) Field of Search ..... 42/70.01, 70.06; 89/147–148

(56) References Cited

U.S. PATENT DOCUMENTS 4,391,058 A * 7/1983 Casull ..... 42/69.02
4,428,138 A 1/1984 Seecamp
4,539,889 A 9/1985 Glock
4,825,744 A 5/1989 Glock
4,893,546 A 1/1990 Glock
5,355,768 A 10/1994 Felk ..... 42/70.06
5,402,593 A * 4/1995 Lenkarski et al. ..... 42/70.06
5,433,028 A 7/1995 Novak et al. ..... 42/70.11
5,560,134 A 10/1996 Van Niekerk et al. ..... 42/70.06
5,630,134 A 5/1997 Haga ..... 42/70.11
5,655,326 A * 8/1997 Levavi et al. ..... 42/70.01
5,705,763 A * 1/1998 Leon ..... 89/140
5,755,054 A 5/1998 Tuller
6,070,512 A * 6/2000 Rohrbaugh ..... 89/147
6,212,812 B1 4/2001 Aigner ..... 42/70.06
6,223,460 B1 * 5/2001 Schmitter et al. ..... 42/70.06
6,301,816 B1 10/2001 Saltz ..... 42/70.07
6,405,468 B1 * 6/2002 Gilgenbach ..... 42/70.06
6,499,243 B1 * 12/2002 Herzog ..... 42/70.07
6,510,639 B2 1/2003 McMoore ..... 42/70.11
6,519,888 B1 2/2003 Oberst

OTHER PUBLICATIONS

Instructions for Use; Bedienungsanleitung; Mode D'Emploi; Instrucciones de Manejo, "Glock Semiautomatic Pistols", GLOCK Perfection, pp. 1–34, no date.

* cited by examiner

*Primary Examiner*—Jack Keith
*Assistant Examiner*—L. Semunegus
(74) *Attorney, Agent, or Firm*—Crowell & Moring LLP

(57) ABSTRACT

A trigger assembly is adapted to replace the trigger and trigger safety assembly supplied in pistols for enhancing safety features. The invention is formed by a sideways insertable locking pin, a newly designed trigger safety member and a helicoidal spring. The user may lock the pistol trigger assembly by pushing the locking pin to one safe position, and unlock it with an opposite movement.

32 Claims, 5 Drawing Sheets

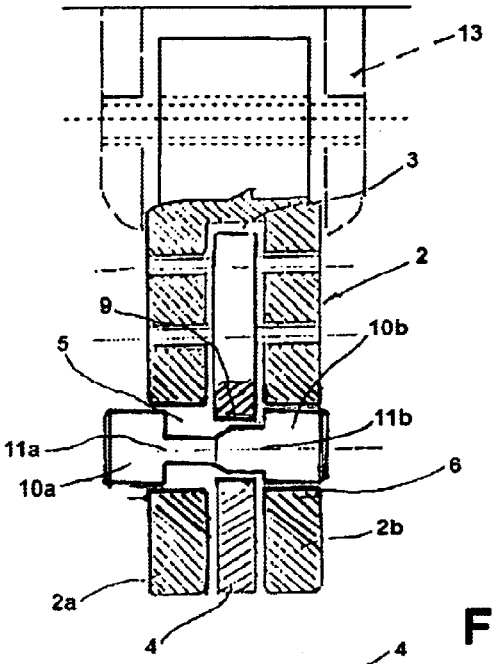
FIG. 4
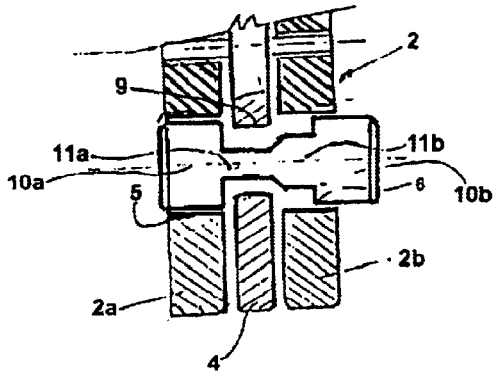
FIG. 5
FIG. 6A
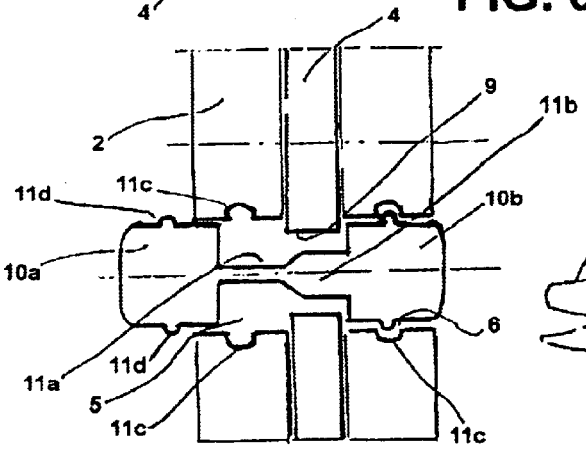
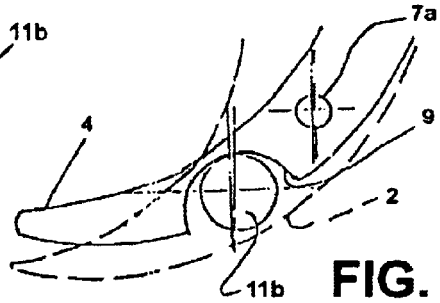
FIG. 6B
FIG. 7A
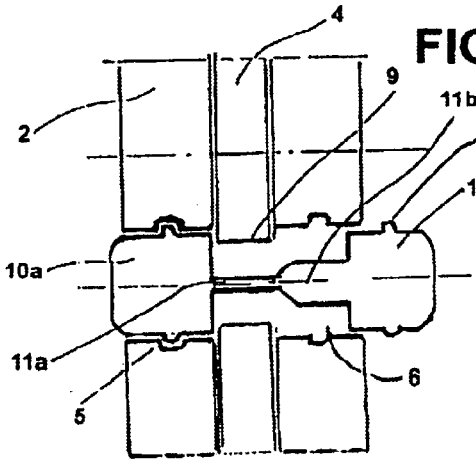
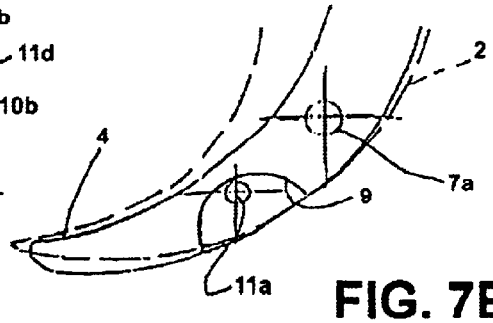
FIG. 7B

TRIGGER SAFETY LOCK FOR PISTOLS AND TRIGGER ASSEMBLY

RELATED DOCUMENTS

The present invention claims priority of Argentine Patent Application No. P02 01 01459, filed on Apr. 22, 2002 and Argentine Patent Application No. P03 01 01344, filed on Apr. 16, 2003.

BACKGROUND OF THE INVENTION

The present invention relates to a lock for trigger safety to be used in firearms triggers and a trigger assembly that contains the trigger safety lock, to be used particularly in hand held pistols. Preferably, the invention is to be applied, and is an improvement, to the safety mechanism used in pistols with brand GLOCK®, which will be called, for simplicity, from now on this document as the GLOCK® safety mechanism.

The trigger safety lock of the present invention allows for adding safety features to the known GLOCK® safety mechanism, particularly in those cases in which the user is forced to walk through places of difficult access while holding the pistol in his hand. Obstacles such as figs, bushes, or any kind of interfering elements that may be found in countryside or city environments may get caught in the trigger and cause accidental shots.

The GLOCK® safety mechanism is one of the mostly used safety features in firearms. In these mechanisms, apart from the internal safety mechanisms, the pistols also show a secondary trigger, also called trigger safety member, formed by a pivotally mounted member placed inside a slot made in the main trigger, which protrudes at the lower front portion of the main trigger. The trigger safety member has a rear protruding blocking portion which abuts against the wall of the hand grip placed right behind the trigger when the pistol should be locked.

Although the GLOCK® mechanism is known worldwide to be one of the safest and most effective one, it may still be improved. Since the main trigger and the secondary trigger are both housed very nearby, and both acting in the same direction when the user pulls them for shooting, any foreign object that accidentally gets into the trigger guard housing and getting in the way of the trigger assembly may press on both elements and produce an unwanted shot.

Most hand weapon manufacturers have models designed for police or military use. These weapons usually have a strap engaged to the rear part of the hand grip. On several occasions, police o security personnel have to run with the weapon in their hand and a simple stumble may cause the weapon to fall several feet away from them, unless they use the strap. However, when doing so, this element has also shown to be quite dangerous if the weapon uses the GLOCK® safety mechanism because the strap gets tangled in the trigger mechanism and causes accidental shots when the weapon is placed in its holster.

Another way of improving the safety of GLOCK® mechanism by adding a sliding type element or lever acting mechanism at the side of the pistol, like the one used in the old Colt® 45 pistols would not be easily feasible, because it would imply doing major and costly amendments to the weapon.

Other weapons such as the old Remington® rifles of the early years of the XX century and several other caliber 22 rifles had a safety mechanism placed behind the trigger guard consisting of a cylinder with a groove that prevented the trigger to slide to the back when the rifle was locked. Nowadays, several repetition ammunition shotguns still use this old mechanism. However, none of these seems to be useful for improving the GLOCK® safety mechanism.

The safety lock of the present invention is an improvement to the GLOCK® secondary trigger safety and was designed to be operated from the side of the trigger with a transverse movement to avoid any possible accidental locking or unlocking engagement while the pistol is out of its holster. Attempts for amending the GLOCK® trigger assembly for letting it work in an improved way failed. A careful analysis of the trigger manufactured by GLOCK® shows that it is too thin for making a side through-hole for inserting a locking pin of suitable diameter (around 4.0 mm) or making a 2.00 mm notch for letting the pivoting safety member (secondary trigger) be lowered for acting in the way the present invention does. Other issue in this trigger assembly that should be solved is the fact that the elastic member that biases the GLOCK® safety member (secondary trigger) for returning it to an initial position after being triggered is an integral part of the member itself. The whole safety member, including its elastic biasing member, is made of acetal resin, a low cost polymer that is not adequate for heavy duty, long term, alternative stress. Acetal resin tends to lose flexibility in the long term and may finally break due to material fatigue to bending stress. Therefore this biasing member was replaced in the improved safety member by a biasing helicoidal spring, preferably made of stainless steel. However, a biasing member made of polyurethane may also be an acceptable alternative solution since this material is highly resistant to bending fatigue.

In the first preliminary prototypes, a cedar wood trigger was used, with its lower portion thickened for achieving better resistance after doing the side hole for inserting the locking pin, and a thicker safety member made of aluminum. The first prototypes also included a locking pin made of hard aluminum and, although these materials proved to be not adequate for the invention, they allowed to prove that the design may be carried out.

A further prototype included an electrolytic bronze trigger which was useful for making a die that was further used for injecting several prototype triggers made of acetal resin, i.e. the same material as the one used by the manufacturer of the GLOCK® pistol. In this prototype the locking pin was made of Teflon®, a polymer of very good sliding features. However, making such small elements with sufficient precision using the turning lathe on this material proved to be cumbersome because the machine tends to bend the finished member. In an attempt to overcome this issue a 1 mm thick steel-silver rod was inserted in the Teflon® rod but the whole process proved to be too complicated for industrial purposes, and was finally discarded.

A further prototype was made with a locking pin made of bronze housed in an acetal resin trigger, but this material proved to be not resistant enough to wear-out. In an attempt to avoid wear-out, and for improving the engagement of the locking pin inside the trigger, a pair of synthetic rubber O'Rings were placed in corresponding grooves made on the locking pin's surface, but these O'Rings were torn very soon.

A preferred embodiment of the present invention was finally obtained by using polyurethane for both the trigger and the safety member (secondary trigger). However, since the trigger would have to resist the user's hand triggering pull, it was made with 60 D Shore polyurethane to achieve better flexibility features; on the other hand the safety member was made with 74 D Shore to achieve better rigidity and hardness features. After several tests, it was found that the best material for making both elements proved to be the BASF® polyurethane due to its exceptional endurance properties, and leaving the BAYER® polyurethane as a second choice. The locking pin was made by machining a 4.5 mm 12 L 14 carbon steel rod, an easily obtainable element in most markets, to get a 4.0 mm steel rod and further chroming preferably by electrolytic process, to obtain a chromed steel locking pin.

A highly preferred embodiment includes two protruding ridges made on the surface of the end portions of the locking pin and corresponding grooves made on the inner surface of the trigger for safely keeping the pin engaged in the selected position (i.e. locking or unlocking the trigger). Furthermore, the preferred embodiment also is designed so that the force for locking the pistol is greater than the force required to unlock it. This was done for safety reasons, taking in account that the user may be under great mental stress when he needs to unlock the pistol, while the act of locking it may probably be done in a more relieved state of mind. This is achieved by letting the ridge of the locking side end be slightly higher than the other one.

DESCRIPTION OF THE PRIOR ART

Improvements in safety elements applied to firearm triggers for avoiding accidental firing are well known in the art.

U.S. Pat. No. 6,301,816 B1 describes a safety device for firearms. In one embodiment, the document describes a threaded aperture located in a rear position of a firearms' trigger, toward the handle. The preferred location of aperture is located close to an upper rear corner of an exposed surface of the trigger. Inserted into the threaded aperture is a complementary threaded barrel screw. The crew has a special keyed head. The key configuration of the head prevents inadvertently reversing the safety mechanism. In a preferred embodiment, the keyed head has a pentagonal shaped indentation and generally centered within the indentation is an outwardly projecting guide pin. When the screw has been inserted into the aperture, there are two function positions. In a use position, the screw is contained in the trigger and does not substantially project from the trigger. In a safe position, the screw has been advanced from the use position, by use of the special key, and projects from the trigger a sufficient amount to block substantial movement of the trigger. The screw blocks the movement of the trigger by projecting to a position adjacent the firearm frame. However, the cited document does not anticipate de matter described in the present invention because the latter is aimed to improve a GLOCK® type safety feature without the need of auxiliary keys and only by pressing the head of a security bolt.

U.S. Pat. No. 6,212,812 B1 describes a pistol that comprises a butt containing a trigger mechanism and a barrel slide which can be displaced in the longitudinal direction, the trigger being guided in the upper part of the butt. In order to permit rapid, simple and reliable locking and unlocking, a locking pin is guided so that it can be displaced and rotated in a lateral transverse hole in the butt. The locking pin protrudes into the path of the trigger in the locked condition. A compression spring acts on the locking pin in the unlocked position and the locking pin has a head which interacts in bayonet fashion with an enlarged portion of the hole so that two different angular positions of the locking pin correspond to the locked and unlocked positions are selected. The trigger mechanism of the cited document does not anticipate the present invention because the former does not describe a locking pin laterally inserted in the trigger and having at least two different cross sections that allow the user to lock or unlock the trigger mechanism by sliding the pin sideways.

U.S. Pat. No. 6,510,639 shows a locking, grip-enclosed safety device for a firearm. The grip-enclosed mechanism has an externally-operable locking selector which is operable by a user to be locked into distinct armed and unarmed positions. The locking selector actuates a mechanical trigger/firing mechanism interruption member between distinct armed and unarmed positions. However, this safety mechanism is not based on a locking pin that is laterally inserted in the trigger assembly.

U.S. Pat. No. 5,433,028 B1 describes a device that selectively locks the trigger of a firearm by the action of a hollow pin that, pushed by a spring, fits inside a cavity made at the bottom of the trigger. This hollow pin is welded to a flat steel bar that fits along a groove inside the horizontal part of the trigger guard. This trigger guard is made of a non-magnetizable material. The flat steel bar pivots by the use of a horizontal pin that can be locked at the front of the trigger guard, depending of the needs of the designers of the different guns. This flat steel bar has an up and down motion to lock and unlock the trigger. To release the trigger, the user of the gun wears a flat magnet with a magnetization pattern parallel to its thickness. This magnet should be attached to the exterior surface of the second phalanx of the middle finger of the shooting hand either mounted to a ring or sewn to a glove. In this way the magnet will be located under the trigger guard when the gun is held, and the pulling of the magnet will move the bar and the locking pin (hollow pin) down, unlocking the firearm. If the gun is dropped or taken away from the owner, it won't shoot. Neither will shoot if someone takes the gun unaware of the need of the magnet. However, the trigger safety of the cited document is different from the one of the present invention because the former does not define a locking pin that is transversally placed in a GLOCK® type trigger safety for improving its safety features.

U.S. Pat. No. 5,355,768 shows a select fire automatic pistol comprising: a frame; a slide with a breech-block in the rear which slides on the frame over the barrel to form a cartridge receiving chamber; a floating barrel in the slide having a cartridge receiving rear; a trigger safety lever for preventing the movement of the trigger to the activating position; a magazine drop safety to stop the trigger moving to the activated position when the magazine is not fully seated; a trigger bar connected to the trigger including an ledge for displacement of the firing pin backwards to the rear position; a firing pin including a foot on its rear for engagement with the trigger bar ledge and having a spring threaded on the rear of the firing pin for propelling same forward into the cartridge chamber to fire a cartridge and a spring threaded on the front of the firing pin urging same backwards to stop it entering the cartridge chamber if the pistol is dropped; an ejector plate to eject the empty shells, create a safety zone and stabilize the ledge of the trigger bar; an activating rod for engagement with the inclined edge of the trigger bar for displacement of the firing pin foot out of operative engagement with the trigger bar ledge when the trigger is moved into the activated position and to allow the trigger bar ledge to be lifted up into the path of the firing pin foot for engagement with the trigger bar ledge into the ready position; an extractor, to extract an empty cartridge, which automatically snap locks itself in its cavity in the breech-block; a select fire switch to select between semi-auto mode or the full-auto mode. However, the safety mechanism of the cited patent does not anticipate the present invention because the former does not describe a locking pin with portions having different cross sections that is transversally placed in a GLOCK® type trigger safety for improving its safety features.

U.S. Pat. No. 5,560,134 shows a trigger related safety device for a firearm or the like comprising a secondary trigger (24) which is reciprocally movable relative to the main trigger (10) between a first or operative position and a second or inoperative position, and a locking member (35) associated with the secondary trigger (24) which, when the latter is in the said operative position, serves positively to lock the main trigger (10) to a stationery part of the firearm or the like so preventing the main trigger (10) from moving in the direction where the firing mechanism of the firearm will be activated, and when the secondary trigger (24) is in the said inoperative position, the main trigger (10) is free to move in the said direction. Although the use of a locking member for securing the secondary trigger might be considered similar to the present invention, there are several structural features that may distinguish one invention from the other. In the present invention the locking pin and the replacement safety trigger are carefully designed to exactly match and replace the trigger assembly used in GLOCK®type pistols. The locking pin of the present invention shows two end portions for locking the pin to its housing and two central portions having different cross sections. The drawings of the present invention show that these central sections carry out the main function of the invention by alternatively locking or releasing the trigger safety member (secondary trigger) of the present invention. This is achieved due to the fact that the safety member of the present invention is tightly locked against the thicker cross section of the locking pin and is unlocked and loose when it is facing the thinner cross section of the locking pin. The cited patent, however, does not describe this way of locking the trigger.

SUMMARY OF THE INVENTION

The present invention is formed by an assembly formed by a (main) trigger, a novel safety member (secondary trigger), a novel locking pin, and a biasing spring.

The carefully designed locking pin is inserted in a through-hole that is made on each side of the trigger and is longer than the trigger in itself so that it may be pushed by the user by pressing on the locking pin projecting out of one of the trigger's side, for locking the trigger assembly, and unlocking it by pressing on the opposite side. The locking pin shows two end ridged portions of greater diameter and two central portions of different diameters, both smaller than the end portions. The locking pin may also be useful for left handed users since insertion of the locking pin may easily be inverted for this use.

Although the locking pin is preferably made of chromed carbon steel, in an alternative embodiment, it may be also totally or partially covered with a polyurethane, Teflon®, acetal resin, or similar product coating.

In a highly preferred embodiment, each of the different portions of the locking pin has circular cross section; however other alternative embodiments may consider the use of ellipsoid or elliptic cross sections or other geometric figures such as triangles, four sided figures and other polygons, all with rounded vertices. These alternative cross sections may offer a better locking pin engagement, avoiding a rotation around its symmetry axis but, at the same time, these cross section profiles may produce excessive trigger material wear-out.

BRIEF DESCRIPTION OF THE DRAWINGS

FIG. 4 shows a front cross section of an early embodiment of the trigger assembly without ridges, in a locked position;

FIG. 5 shows a front cross section of an early embodiment of the trigger assembly without ridges in an unlocked position;

FIG. 6A shows a front cross section of a preferred embodiment of the trigger assembly including ridges, in a locked position;

FIG. 6B shows a front cross section of a preferred embodiment of the trigger assembly including ridges, in an unlocked position.

FIG. 7A shows a schematic side view of the safety member in a locking position;

FIG. 7B shows a schematic side view of the safety member in an unlocking position;

DESCRIPTION OF THE PREFERRED EMBODIMENT OF THE INVENTION

Figure 1:
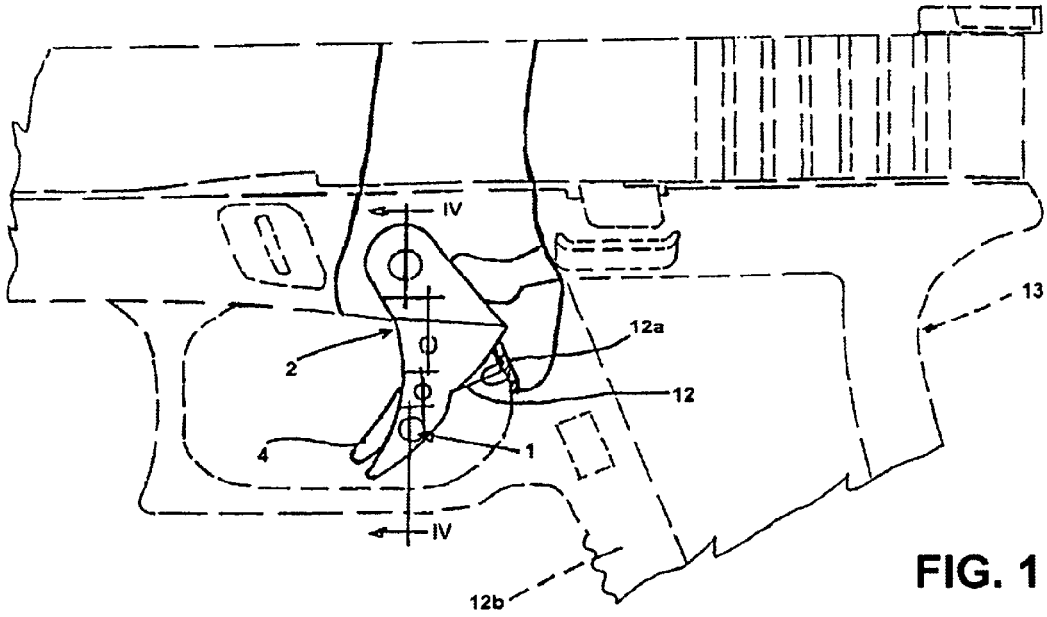
FIG. 1 shows a partial side view of a GLOCK® type pistol, showing the trigger assembly of the present invention.
Figure 2:
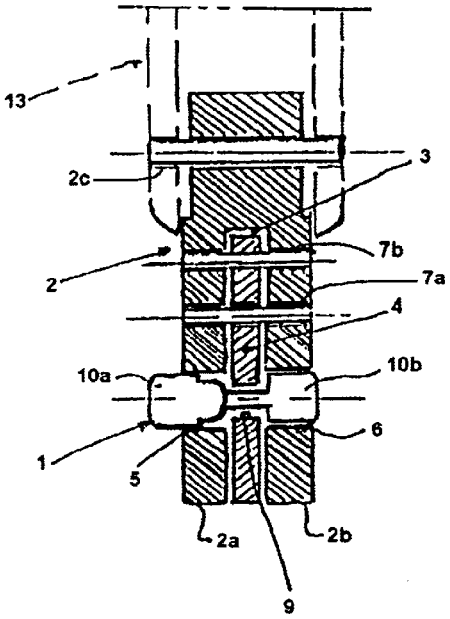
FIG. 2 shows a cross section at IV—IV of the trigger assembly of the present invention in FIG. 1.
Figure 3:
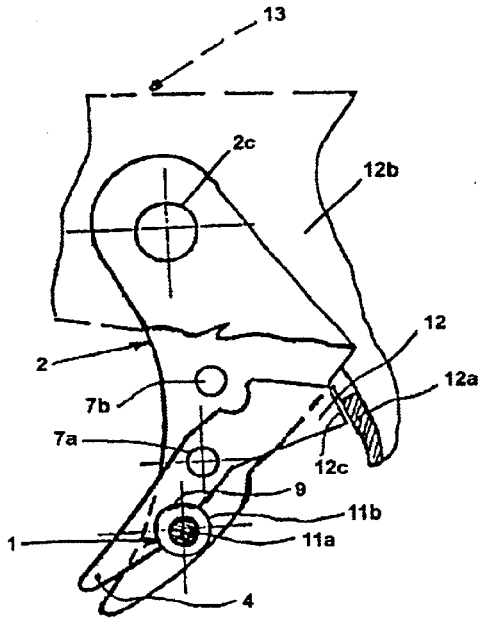
FIG. 3 shows a detail section of the trigger assembly of the present invention of FIG. 1.
Figure 8B:
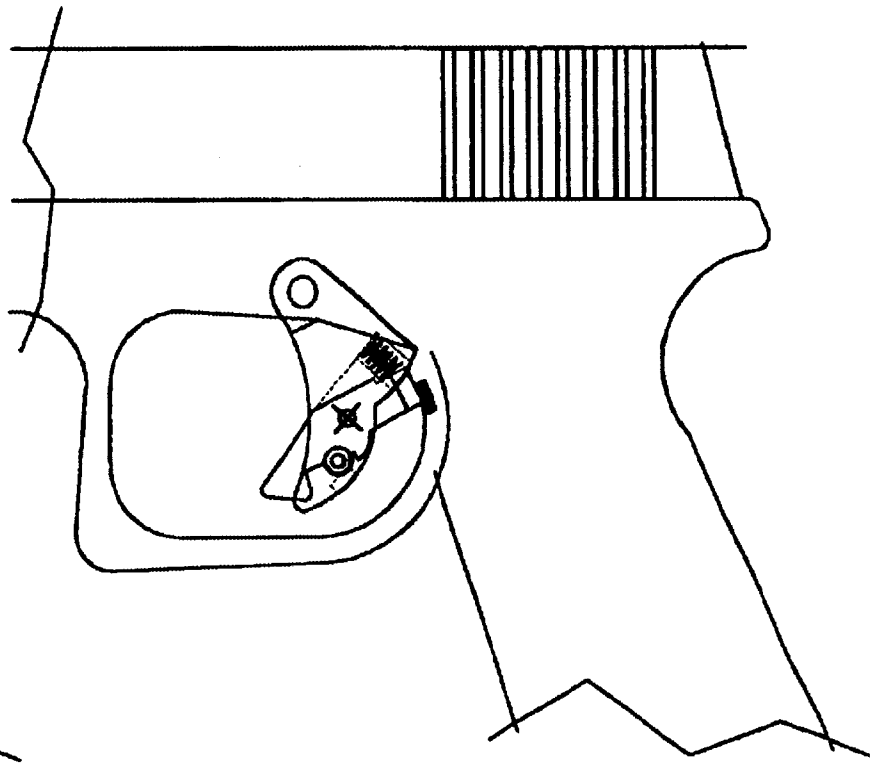
FIG. 8B shows a partial schematic side view of the trigger assembly in a locked position.
Figure 8A:
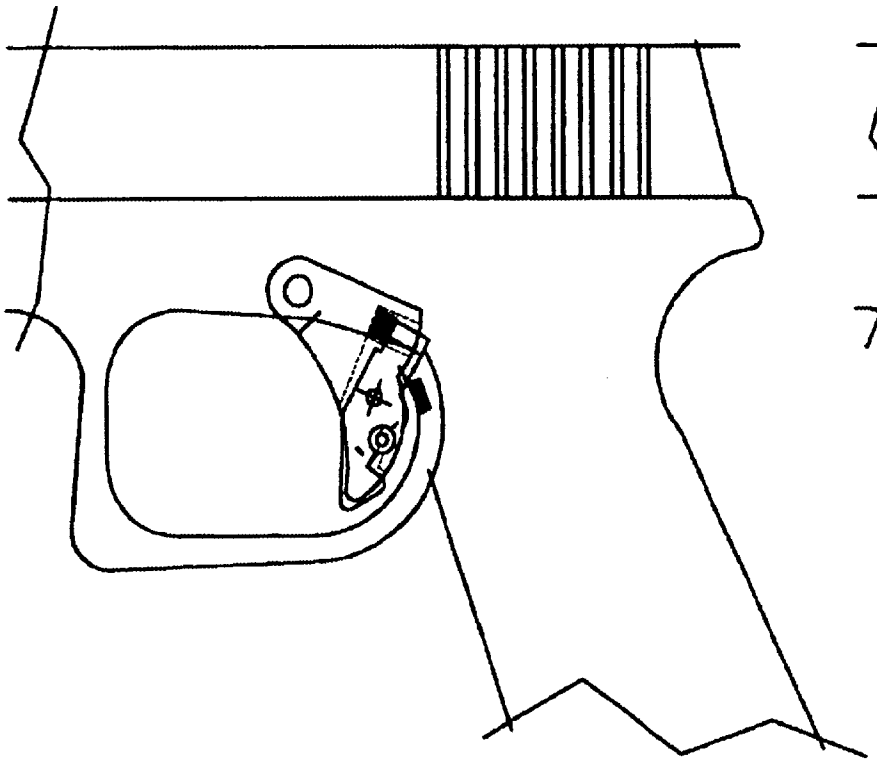
FIG. 8A shows a partial schematic side view of the trigger assembly in an unlocked and triggered position.

FIGS. 1, 2 and 3, show a pistol 13 comprising a (main) trigger 2 and a safety member (secondary trigger) 4 which may rotate around an axis 2*c* and also including a locking pin 1. In FIG. 2 it may be seen that the safety member 4 is housed inside a central cavity 3 inside the trigger 2, between trigger sides 2*a* and 2*b*.

For sake of clarity the trigger assembly of the prior art will now be described (i.e. the trigger assembly supplied by the manufacturer of the GLOCK® pistol).

Figure 9A:
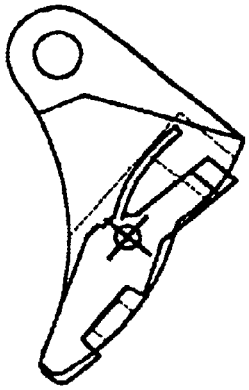
FIG. 9A shows a side view of the GLOCK® prior art trigger assembly showing the safety member in an unlocked position.
Figure 9B:
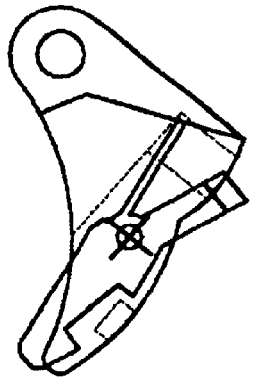
FIG. 9B shows a side view of the GLOCK® prior art trigger assembly showing the safety member in a locked position.

In FIGS. 9A and 9B it is shown that the safety member may pivot around a rotation axis and the safety member comprises a rear blocking portion which, if the safety member is not pressed by the user, will lock the trigger assembly. This is achieved because, in a locking position, the rear wall of the rear portion abuts against the front wall of the pistol's hand grip. When the user presses on the trigger and on the safety member simultaneously, the trigger may rotate around its axis (in a counterclockwise direction) and the safety member also rotates around its axis, till it abuts against the stop pin. When rotating, now the rear wall of the rear portion does not abut against the wall because it travels rearwards above this wall and allows the trigger assembly to be freely activated, allowing the pistol to shoot. Therefore, the GLOCK® pistols include a safety feature that may at first seem effective if a foreign element happens to press on the trigger side portions without pressing the safety member. However, as was explained before, the probability that a foreign element or even the pistol's strap presses on all three elements is quite high and has proven to cause many unwanted shots. Therefore this mechanism need to be improved.

FIGS. 2–5 show a first embodiment of the trigger assembly of the present invention comprising a new trigger 2, a new safety member 4, a locking pin 1 which is inserted passing through the trigger's side walls 2*a* and 2*b* and through the internal cavities 5 and 6, and through the notch 9 on the lower side of the safety member 4. It may also be seen that the locking pin 1 comprises two end portions 10*a* and 10*b* and two central portions 11*a* and 11*b*.

FIG. 4 shows the locking position in which the locking pin 1 has been pressed by the user's finger from the right side, inserting the end portion 10*b* and placing the central portion 11*b* facing the safety member's notch 9.

FIG. 5 shows the unlocked position in which the locking pin 1 has been pressed by the user's finger from the left side, inserting the end portion 10*a* and placing the central portion 11*a* facing the safety member's notch 9.

FIG. 6B shows that, in the locking position, the bigger diameter of portion 11*b* allows the notch 9 to abut against the portion 11*b*. Since the notch diameter is substantially equal to the cross sectional diameter of portion 11*b*, the safety member is engaged in a quite tight blocking position and may not rotate around its rotation axis 7*a*.

FIG. 7B shows that, in an unlocked position the smaller diameter of central portion 11*a* allows notch 9 pivot to a lower placement which is relatively loose or may also slightly abut against portion 11*a* at that lower position. This is achieved because the diameter of the notch 9 is much greater than the cross section of central portion 11*a*. In this position, the safety member acts very much like the safety member of the originally manufactured safety member (prior art) and the user does not feel the presence of the locking pin 1 when he triggers the pistol. This is a highly beneficial feature of the invention.

Going back to FIG. 3, it may be seen that, once the safety member 4 of the present invention is tightly kept from rotating around its axis 7*a*, the rear portion 12*c* abuts against the hand grip's front wall 12*a*, in the same way as the safety member of the prior art, and therefore locking the trigger assembly. On the unlocked position, the safety member 4 is in a loose state and, in the same way as the safety member of the prior art, if the user presses on the safety member 4, it will rotate around its axis 7*a* till reaching the stop pin 7*b* and the rear portion 12*c* will pass above the hand grip's wall 12*a* without interfering with it.

In a second and highly preferred embodiment of the trigger assembly of the present invention, in which each end portion 10*a* and 10*b* comprise a corresponding ridge 11*d* and each trigger side wall 2*a* and 2*b* comprise corresponding grooves 11*c* to receive the mentioned ridges. This improvement is aimed to obtain a enhanced engagement of each of the locking and unlocking positions. In a preferred embodiment the mentioned grooves 11*c* show semi circular cross sections but in other alternative embodiments these may be ellipsoidal. In a first embodiment the diameter of both ridges may be the same.

In another highly preferred embodiment the force for displacing the pin into a locking position of the trigger assembly is greater than the force for displacing the locking pin into an unlocking position due to the reasons explained above. Several test made with a dynamometer have shown that a force for inserting the locking pin into a locked position should be in the range of 0.5 Kg to 3 Kg and preferably around 1.8 Kg. The tests have also shown that the force for inserting the pin into an unlocked position should be in the range of 0.5 Kg to 2 Kg and preferably 1.3 Kg. These forces are obtainable by machining the locking pin so that the diameter to the top of the ridge 11*d* on portion 10*a* (locking side) is preferably 4.30 mm (+0; −0.02 mm), and the diameter to the top of the ridge 11*d* on portion 10*b* is preferably 4.28 mm (+0; −0.02 mm). It may be seen in FIGS. 6A and 7A that both ridges 11*d* are placed in the middle of the length of each end portion 10*a*, 10*b*, and the width of each ridge 11*d* was found to be preferably of around 0.8 mm.

Other tests have shown that preferably the total length of the locking pin is of around 12.0 mm, the length of each end portion 10*a*, 10*b* is of around 3.25 mm, the length of the thicker central portion 11*b* is of approximately 2.5 mm, and has a cross sectional diameter of around 3.5 mm. The thinner central portion 11*b* has a length of around 3.0 mm and a cross sectional diameter of around 1.5 mm. Both central portions are separated by as frustoconical transition portion of around 0.5 mm.

Figure 10A:
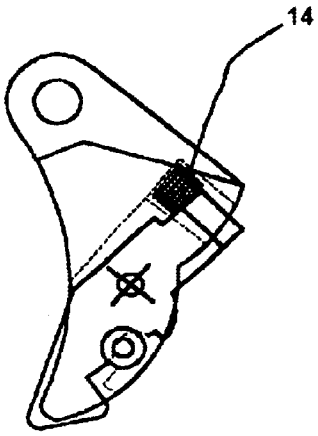
FIG. 10A shows a side view of the trigger assembly of the present invention in a unlocking position.
Figure 10B:
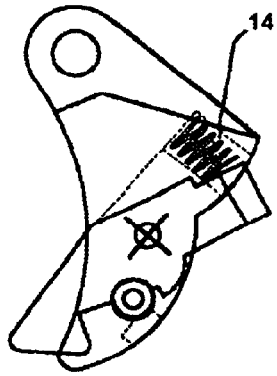
FIG. 10B shows a side view of the trigger assembly of the present invention in a locking position.
Figure 12B:
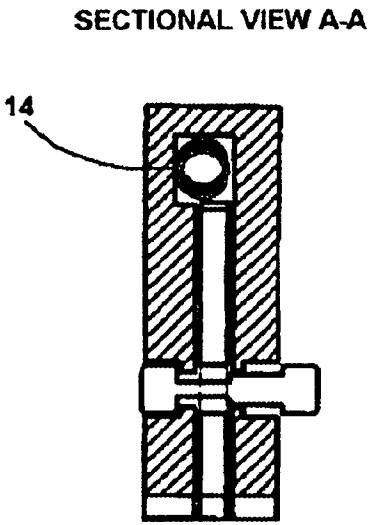
FIG. 12B shows the sectional view through line A—A of FIG. 11 in an unlocked position.
Figure 12A:
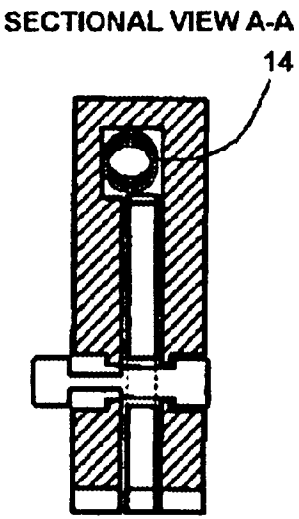
FIG. 12A shows the sectional view through line A—A of FIG. 11 in a locked position.
Figure 11:
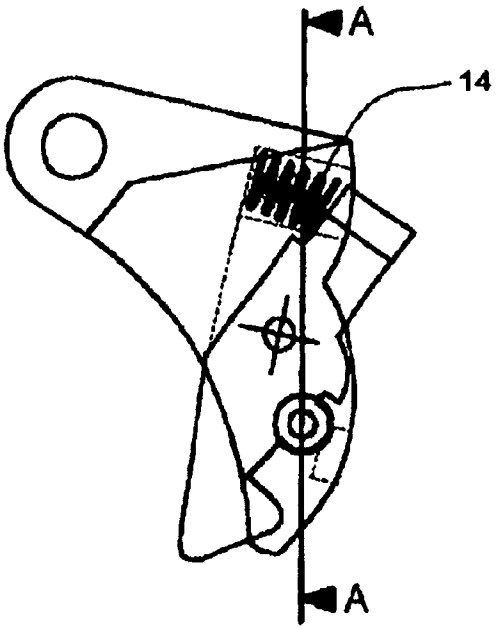
FIG. 11 shows a side view of the trigger assembly of the present invention showing the metal spring.

The trigger assembly of the present invention also includes a novel safety member 4 which has an improved design compared to the prior art safety member. The previously issue referred to the elastic biasing element was solved by replacing it by a helicoidal spring 14 made of stainless steel. However, alternatively, other suitable materials such as phosphorous bronze may also be used. Also an elastic member made of suitable polyurethane polymer may be used. It may also be seen in FIGS. 10A, 10B and 11 that the lower edge of the safety member, next to the notch 9, was kept straight to avoid interference with a front bridging piece (not shown in the drawings) that keeps both trigger halves 2*a* and 2*b* linked one to the other.

Finally, the profile of the notch 9 was also carefully designed after several tests. A first prototype was made with a circular notch with 3.5 mm diameter (matching the cross sectional diameter of the thicker central portion 11*b*). However, further tests showed that the preferred profile for the notch should be distorted to be formed by a first circular front half and a rear nearly elliptical half, in order to better abut against the corresponding thicker central portion 11*b* and, at the same time allow for an easy insertion of the locking pin 1 when assembling the trigger and safety member. In order to avoid the locking pin falling out of its housing, the end portions 10*a* and 10*b* show a diameter of around 4.0 mm, i.e. 0.5 mm greater than the central portion 11*b* and also 0.5 mm greater than the notch 9. In this way the notch 9 will act as a stop to any of those end portions if the locking pin 1 is further pushed by the user.

What we claim is:

1. A trigger safety for a fire weapon, the weapon comprising a hand grip and a trigger, the trigger comprising two sidewalls and a central slot between the sidewalls and able to rotate around a first axis, the trigger safety comprising: a safety member mounted inside said central slot and able to pivot around a second axis, said second sidewalls of the trigger; and a locking pin comprising two end axis being fixed to the portions and two central being of different cross section portions, said central portions diameters; said sidewalls of the trigger comprising cavities and said safety member comprising a notch formed on its lower edge, the notch being aligned with said cavities for allowing said locking pin to be laterally inserted into said trigger through said cavities and through the notch, and allowing the pin to axially slide from a first position to a second position and vice versa; the first position, the notch of the safety member abuts against the central portion of the pin of smaller diameter, thus urging the safety member rotate around the second axis to a first position in which, when pressed by the user's finger, the safety member is free to rotate together with the trigger around the first axis, thereby freely allowing triggering of the weapon; and wherein, with said pin placed wherein, with said pin placed in the second position, the notch the safety member abuts against the central portion of the pin of greater diameter, thus urging the safety member to rotate around the second axis to a second position in which, when pressed by the user's finger, a rear portion of the safety member abuts against a portion of a front wall of the hand grip, thereby preventing the safety member from rotating around the first axis, thus blocking the rotational movement of the trigger and therefore blocking the triggering of the weapon.

2. The trigger safety of claim 1, wherein said end portions have substantially equal cross section diameters.

3. The trigger safety of claim 1, wherein said end portions have different cross section diameters.

4. The trigger safety of claim 1, wherein each end portion and each central portion of said locking pin have circular cross sections.

5. The trigger safety of claim 1, wherein at least one of said end portions and at least one of said central portions of said locking pin have cross section profiles with rounded vertices, taken from the group formed by ellipses, ellipsoids, triangles, four sided figures and polygons.

6. The trigger safety of claim 1, wherein said locking pin is made of metal.

7. The trigger safety of claim 6, wherein said metal is carbon steel.

8. The trigger safety of claim 6, wherein said metal has its surface totally or partially chromed.

9. The trigger safety of claim 7, wherein said metal has its surface totally or partially chromed.

10. The trigger safety of claim 6, wherein said locking pin is totally or partially coated with a product taken from the group formed by polymers such as polyurethane, Teflon® and acetal resin.

11. The trigger safety of claim 7, wherein said locking pin is totally or partially coated with a product taken from the group formed by polymers such as polyurethane, Teflon® and acetal resin.

12. A trigger safety for a fire weapon, the weapon comprising a hand grip and a trigger, the trigger comprising two sidewalls and a central slot between the sidewalls and able to rotate around a first axis, the trigger safety comprising:

a safety member mounted inside said central slot and able to pivot around a second axis, said second axis being fixed to the sidewalls of the trigger; and a locking pin comprising two end portions and two central portions, said central portions being of different cross section diameters;

each of said sidewalls comprising a cavity and said safety member comprising a notch formed on its lower edge, said notch being aligned with said cavities for allowing said locking pin to be inserted through both cavities and through the notch and axially slid by the user from a first position to a second position and vice versa;

wherein, when the pin is slid to the first position, the safety member rotates to a first position in which said notch abuts against the central portion of smaller diameter of the pin;

wherein, when the pin is slid to the second position, the safety member rotates to a second position in which said notch abuts against the central portion of greater diameter of the pin;

wherein, when placed in the first position, the safety member is free to rotate together with the trigger when pressed by the user, unlocking the triggering of the pistol;

wherein, when placed in the second position, the safety member is pivotally displaced and therefore abuts against a rear wall of the grip when pressed by the user, blocking the rotational movement of the safety member and thus blocking the triggering of the weapon; and wherein said end portions comprise ridges for insertion in corresponding grooves on said internal cavities for improving locking pin engagement in the user's selected position.

13. The trigger safety of claim 12, wherein said end portions have substantially equal cross section diameters.

14. The trigger safety of claim 12, wherein said end portions have different cross section diameters.

15. The trigger safety of claim 12, wherein each end portion and each central portion of said locking pin have circular cross sections.

16. The trigger safety of claim 12, wherein at least one of said end portions and at least one of said central portions of said locking pin have cross section profiles with rounded vertices, taken from the group formed by ellipses, ellipsoids, triangles, four sided figures and polygons.

17. The trigger safety of claim 12, wherein said locking pin is made of metal.

18. The trigger safety of claim 17, wherein said metal is carbon steel.

19. The trigger safety of claim 17, wherein said metal has its surface totally or partially chromed.

20. The trigger safety of claim 17, wherein said metal has its surface totally or partially chromed.

21. The trigger safety of claim 17, wherein said locking pin is totally or partially coated with a product taken from the group formed by polymers such as polyurethane, Teflon® and acetal resin.

22. The trigger safety of claim 12, wherein the diameter to the top of both said ridges is equal.

23. The trigger safety of claim 12, wherein the diameter to the top of both ridges is not equal.

24. The trigger safety of claim 12, wherein the diameter to the top of the ridge formed on the end portion that is next to the thicker central portion is bigger than the diameter of the ridge formed on the opposite end portion.

25. A trigger assembly for a fire weapon including a trigger and a trigger safety, the trigger having two sidewalls and a central slot, the trigger safety comprising: safety member pivotally mounted inside said central slot; a locking pin comprising two end portions and two central portions, said central portions being of different cross section diameters; and a helicoidal spring for urging said safety member to return to an initial position after being pressed by the user's finger; each of said sidewalls comprising a cavity and said safety member comprising a notch formed on its lower edge; said notch being aligned with the cavities for allowing said locking pin to be inserted through both cavities and through the notch and axially slid by the user from a first position to second position and vice versa; wherein, when the pin slid to the first position, the safety member rotates to first position in which said notch abuts against the central portion of smaller diameter of the pin; wherein, when the pin is slid to the second position, the safety member rotates to a second position in which said notch abuts against the central portion of greater diameter of the pin; wherein, when placed the first position, the safety member is free to rotate together with the trigger when pressed by the user, unlocking the triggering of the pistol; A trigger safety for a fire weapon, the weapon comprising a hand grip and a trigger, the trigger comprising two sidewalls and a central slot between the sidewalls and able to rotate around a first axis, the trigger safety comprising: a safety member mounted inside said central slot and able pivot around a second axis, said second axis being fixed to the sidewalls of the trigger; and a locking pin comprising two end portions and two central portions, said central portions being of different cross section diameters; said sidewalls comprising cavities and said safety member comprising a notch formed on its lower edge, said notch being aligned with said cavities for allowing said locking pin to be inserted through said cavities and through the notch and axially slid by the user from a first position a second position and vice versa; wherein, when the pin is slid to the first position, the safety member rotates a first position which said notch abuts against the central portion of smaller diameter of the pin; wherein, when the pin is slid to the second position, safety member rotates to a second position in which said notch abuts against the central portion of greater diameter of the pin; wherein, when placed in the first position, the safety member is free to rotate together with the trigger when pressed by the user, unlocking the triggering of the pistol; wherein, when placed the second position, the safety member is pivotally displaced and therefore abuts against a rear wall of the grip when pressed by the user, blocking the rotational movement of the safety member and thus blocking the triggering of the weapon; and wherein said end portions comprise ridges for insertion in corresponding grooves on said cavities for improving locking pin engagement the user's selected position.

26. The trigger assembly of claim 25, wherein said trigger and said trigger safety member are made of polyurethane.

27. The trigger assembly of claim 26, wherein the hardness of said polyurethane for manufacturing said trigger is 60 D Shore.

28. The trigger assembly of claim 26, wherein the hardness of said polyurethane for manufacturing said trigger safety member is 74 D Shore.

29. The trigger assembly of claim 25, wherein said notch has a compound profile formed by a front circular profile next to a rear ellipsoid profile.

30. The trigger assembly of claim 25, wherein said spring is made of metal.

31. The trigger assembly of claim 30, wherein said metal is stainless steel.

32. The trigger assembly of claim 30, wherein said metal is phosphorous bronze.

* * * * *